US006244259B1

(12) United States Patent
Adkins

(10) Patent No.: US 6,244,259 B1
(45) Date of Patent: Jun. 12, 2001

(54) ARCHERY BOW LIMB MOUNTING SYSTEM

(76) Inventor: Daniel K. Adkins, 13716 Carmenita Rd., Santa Fe Springs, CA (US) 90670

( * ) Notice: Subject to any disclaimer, the term of this patent is extended or adjusted under 35 U.S.C. 154(b) by 0 days.

(21) Appl. No.: 09/593,373

(22) Filed: Jun. 15, 2000

(51) Int. Cl.[7] ..... F41B 5/00
(52) U.S. Cl. ..... 124/23.1
(58) Field of Search ..... 124/23.1, 24.1, 124/25.6, 86, 88

(56) References Cited

U.S. PATENT DOCUMENTS

| | | | | |
|---|---|---|---|---|
| 4,261,320 | | 4/1981 | Barna . | |
| 5,231,970 | | 8/1993 | Ploot et al. | 124/23.1 |
| 5,280,779 | | 1/1994 | Smith | 124/88 |
| 5,339,790 | * | 8/1994 | Smith | 124/25.6 |
| 5,411,008 | * | 5/1995 | Hsu | 124/23.1 |
| 5,433,792 | | 7/1995 | Darlington | 124/25.6 |
| 5,464,001 | * | 11/1995 | Peck | 124/25.6 |
| 5,720,267 | * | 2/1998 | Walk | 124/23.1 |

* cited by examiner

*Primary Examiner*—John A. Ricci
(74) *Attorney, Agent, or Firm*—James S. Tak

(57) ABSTRACT

A bow limb mounting system for adjustably mounting a limb inner end of a bow limb to a riser mounting surface of a bow riser of an archery bow, with the limb inner end pivoting relative to the bow riser about a limb pivot axis. The pivot movement is produced by an adjustable strut assembly which varies an attachment angle between the limb inner end and the riser mounting surface, while restraining lateral movement between the two. The adjustable strut assembly has upper head and neck portions which connect to the limb inner end in a close toleranced manner, and an alignment block portion below the neck portion which is slidably and matingly seated in a cavity located below the mounting surface also in a close toleranced manner. A bolt extends through a central hole formed by the head, neck and alignment block portions and connects to a pivot pin, such that adjusting the bolt changes the distance between the limb inner end and the pivot pin to thereby change the attachment angle.

14 Claims, 3 Drawing Sheets

ARCHERY BOW LIMB MOUNTING SYSTEM

BACKGROUND OF THE INVENTION

The field of the invention pertains to archery bows. The invention relates more particularly to a mounting system for adjustably mounting a bow limb to a bow riser of an archery bow, wherein the bow limb may be adjustably pivoted and laterally restrained relative to the bow riser.

Archery involves a high degree of shooting precision and accuracy which is possible in part due to advanced bow configurations and designs. In particular, many modern bows utilize flexible bow limbs which are attached to opposite ends of a rigid bow handle, i.e. bow riser. This arrangement, together with the use of wheels or cams in a compound bow, provides an increase in the mechanical advantage of shooting an arrow. Moreover, adjustment of the attachment or pivot angle between the limbs and the bow riser has the additional benefit of varying the amount of force imparted to the arrow for a given pull distance on the bow string. Consequently, the relative bowstring tension and draw force required to pull the bowstring can be suitably adjusted to a preferential setting.

Perhaps the greatest problem with adjusting the attachment angle, however, is the tendency of the bow limb to twist sideways or misalign relative to the bow riser when the bowstring is pulled and/or released. This tendency can profoundly disrupt a shooters aim and accuracy. To address this problem, various devices and methods have been developed which enable adjustment of the attachment angles between the two bow limbs and the bow riser while restraining the bow limbs from experiencing lateral motion relative to the riser.

For example, in U.S. Pat. No. 5,231,970, a bow limb construction is shown using a single bolt to adjustably attach to a bow riser, and having a bushing with an elliptical bore to seat the bolt on the bow limb. However, in this arrangement the single bolt fastener operates alone to laterally restrain the limb relative to the riser. This configuration may be insufficient to provide the support required against lateral movement, especially when the bolt is sufficiently removed from the riser to produce a large attachment angle between the limb and the riser. Furthermore, because the bolt has a natural tendency under high axial pressures to orthogonally align itself with a longitudinal axis of the bow limb and thereby pivot relative to the riser, its rigidly fastened attachment to the riser may produce undesirable transverse stresses in the bolt.

Additionally, in U.S. Pat. No. 5,433,792, a compound archery bow is shown having a bow limb pivotally secured to a bow riser by means of a bolt fastener. A laterally opening pocket is provided on the riser to receive a nut which receives and secures the bolt fastener. Unlike the '970 patent, however, the '792 patent provides a projection 64 on the riser which engages a notch 62 on the limb to restrain lateral movement. However, the relatively thin and narrow projection may not be sufficient in providing the necessary restraint to prevent lateral movement. Moreover, and similar to the '970 patent, the bolt is again prevented from pivoting relative to the riser, which can be mechanically inefficient when adjusting the attachment angle between the bow limb and riser.

In U.S. Pat. No. 5,280,779, an archery bow is shown provided with pivoting pocket members for attaching each limb to the bow handle. Each pocket has an upper recess for receiving and laterally supporting a limb, and pocket walls which extend away from the recess to straddle the sides of the handle. And in U.S. Pat. No. 4,261,320, a compound bow is shown having its bow limbs seated in a pocket formed in the riser itself in FIG. 23. In either case, the bow limb itself is seated in a pocketed area which supports the bow limb along its side edges. However, the wall structures providing the side restraining support in the '320 and '779 patents may not provide sufficient reinforcement to withstand large lateral loads. This can be seen in FIG. 23 of the '320 patent, where the bow limb is bordered by narrow sidewalls of the pocket portion of the riser, as well as in the '779 patent disclosing relatively thin shoulders 42, 44 of the recess. While suitably wide pocket sidewalls may provide greater lateral restraint, they may be unduly bulky and interfere with the overall slim design of typical archery bows.

In summary, therefore, it would be advantageous to provide a mounting system for adjustably mounting a bow limb to a bow riser, wherein the bow limb is laterally restrained relative to the bow riser in an efficient yet solid manner. Furthermore, an adjustable bow mounting system which pivotally compensates the strut assembly at various attachment angles would provide greater structural stability under the typically high bowstring tensions. It is also notable that due to the variations in bowstring tension which result from adjustment of the attachment angle, it would be further advantageous to provide a mounting system which measures and indicates relative bowstring tension at the various attachment angles.

BRIEF SUMMARY OF THE INVENTION

It is therefore an object of the present invention to provide a simple adjustable bow limb mounting system capable of efficiently adjusting the attachment angle between the bow limb and bow riser, while providing substantial and close-toleranced lateral reinforcement to restrain relative lateral movement.

It is a further object of the present invention to provide a simple and mechanically efficient adjustable bow limb mounting system having an adjustable strut assembly capable of pivoting relative to the riser when the attachment angle between the bow limb and the riser is adjusted.

It is a still further object of the present invention to provide a simple and mechanically efficient adjustable bow limb mounting system having an adjustable strut assembly capable of correctably sliding along a slide surface of the limb inner end when the attachment angle between the bow limb and the riser is adjusted.

It is a still further object of the present invention to provide a mounting system which provides a quick and simple means for measuring relative bowstring tension as a function of the attachment angle between the bow limb and bow riser.

The present invention is for a mounting system for adjustably mounting a bow limb to a bow riser. In a first preferred embodiment, the mounting system comprises a riser mounting end of the bow riser having a mounting surface and a cavity below the mounting surface. The cavity has a pair of opposing cavity sidewalls parallel to a deflection plane of the archery bow. The mounting system additionally has a limb inner end of the bow limb which is preferebly positioned immediately against the mounting surface of the riser mounting end. The limb inner end has means for pivoting the limb inner end relative to the riser mounting end about a limb pivot axis which is normal to the deflection plane of the archery bow. Preferably a bottom surface of the limb inner end contacts the mounting surface of the riser mounting end when the limb inner end remains unpivoted. And the mounting system has an adjustable strut assembly which operates to adjust an attachment angle between the limb inner end of the bow limb and the riser mounting end of the bow riser. The adjustment angle is preferably measured between the bottom surface of the limb inner end and the mounting surface of the riser mounting end. The adjustable strut assembly includes upper means for connecting to the limb inner end of the bow limb which is adapted to laterally restrain the limb inner end relative to the adjustable strut assembly, central means for slidably and matingly engaging the pair of opposing cavity sidewalls whereby the bow limb and the bow riser are restrained from lateral movement relative to each other, lower means for pivotally connecting to the riser mounting end of the bow riser wherein the adjustable strut assembly pivots about a strut pivot axis normal to the deflection plane of the archery bow, and means for adjusting the distance between the upper means and the strut pivot axis of the lower means. Preferably, the upper and central means are integrally connected to provide the lateral restraint.

In a second preferred embodiment, the mounting system includes a set of gradations on the central means of the adjustable assembly which correspond to a range of bowstring tensions. The set of gradations are read relative to the mounting surface of the riser mounting end, for measuring relative bowstring tension of the archery bow as a function of the attachment angle.

And in a third preferred embodiment, the mounting system has a limb inner end with a slide surface and a longitudinally elongated slot, which together enables the upper means of the adjustable strut assembly to correctably slide thereon to compensate for adjustments made to the attachment angle.

DETAILED DESCRIPTION OF THE PREFERRED EMBODIMENTS

Figure 4:
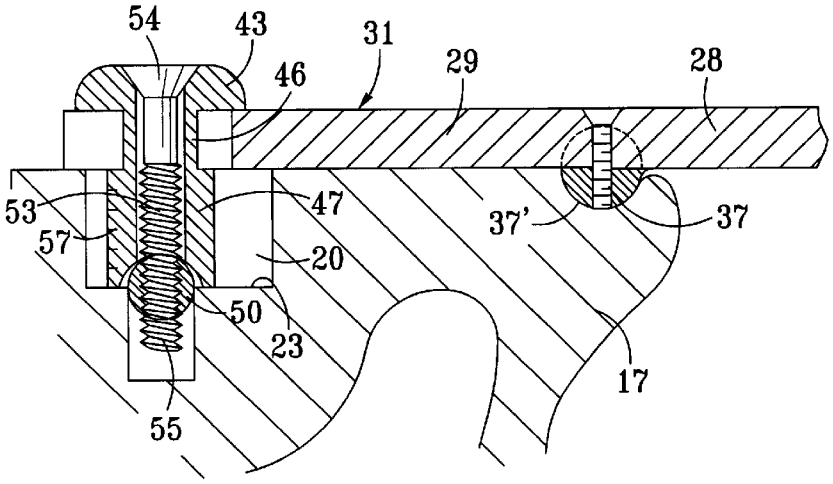
FIG. 4 is a cross-sectional view of the bow limb mounting system taken along line 4—4 of FIG. 2.
Figure 3B:
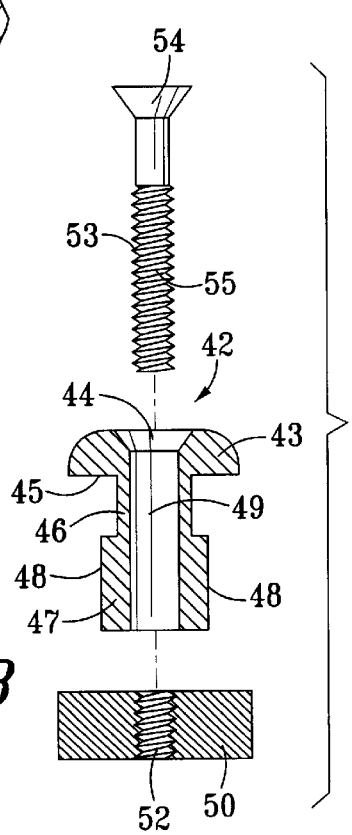
FIG. 3B is an exploded cross-sectional view of the adjustable strut assembly shown in FIG. 3A.
Figure 5:
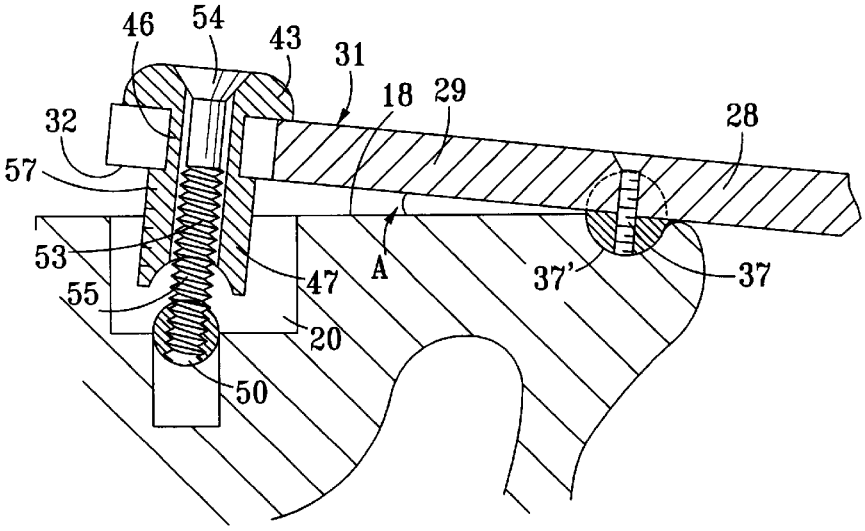
FIG. 5 is a cross-sectional view of the bow limb mounting system following FIG. 4, with the bow limb pivoted relative to the bow riser to achieve a positive attachment angle.
Figure 6:
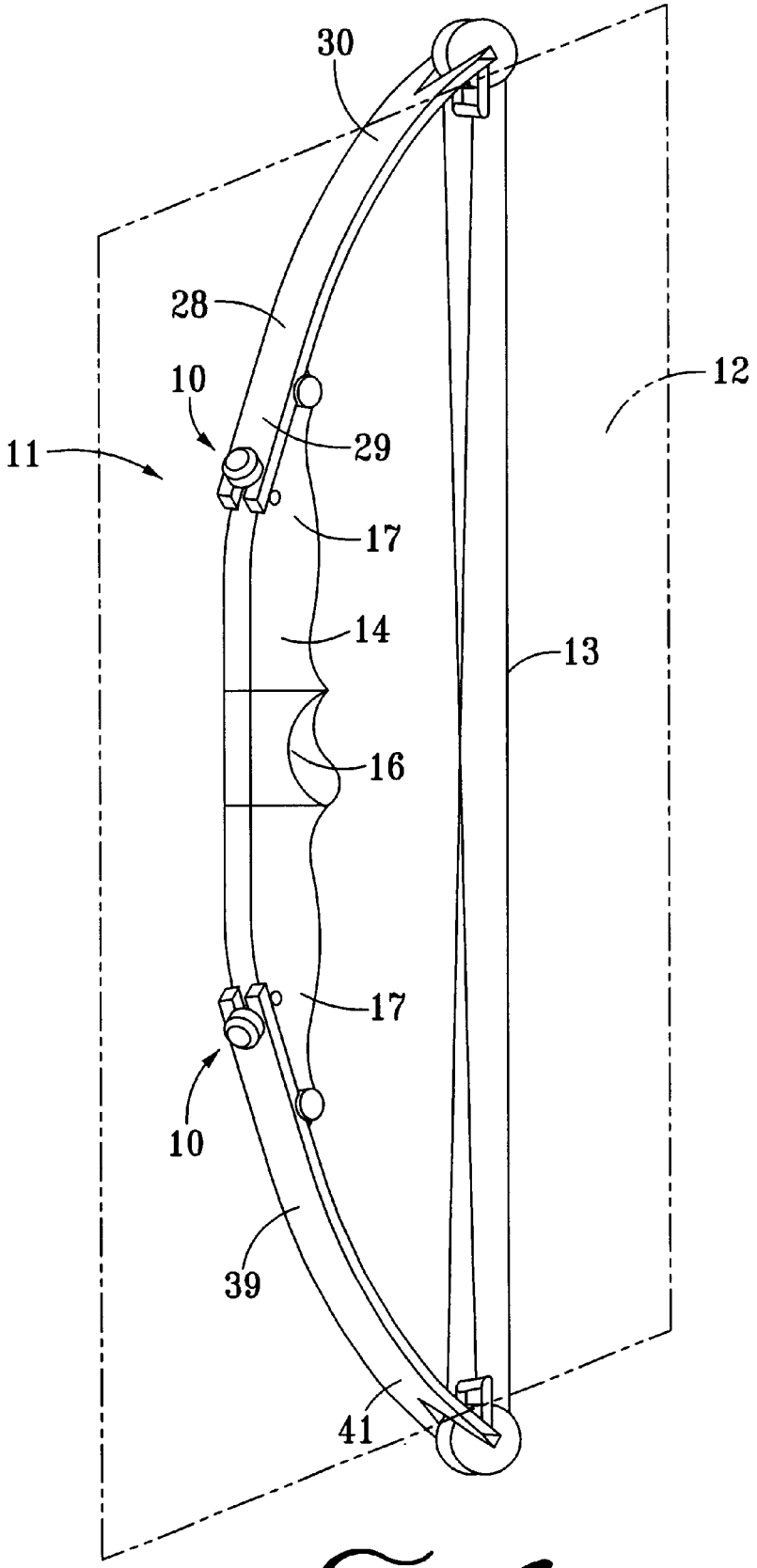
FIG. 6 is a perspective view of the archery bow generally incorporating the adjustable bow limb mounting system.

Referring now to the drawings, FIGS. 1–5 show the mounting system, generally indicated at reference character 10, for adjustably mounting a bow limb 28 to a bow riser 14 of an archery bow, generally indicated at reference character 11 in FIG. 6. As can be seen in FIG. 6, the archery bow 11 has a pair of bow limbs 28, 39 symmetrically attached to the riser 14. Each bow limb 28, 39 has a limb inner end 29, 40, respectively, which secures to corresponding riser mounting ends 17, 27 of the bow riser 14 on opposite ends of a handle portion 16 (discussed in detail below). Additionally, as shown in FIG. 6, each bow limb 28, 39 has an outer end 30, 41, respectively, to which a bow string 13 is connected, such as by wheels or cams in a compound bow. It is notable that while a compound bow configuration is depicted in FIG. 6, it is appreciated that other types of bows may incorporate the mounting system 10 described herein as well. In any case, the archery bow 11 has a deflection plane 12 defined as the generally constant plane of motion exhibited by the bow riser 14, the pair of bow limbs 28, 39, and the bowstring 13, through all degrees of limb deflection and pulling of the bowstring 13. Due to the symmetry of the upper and lower bow limbs 28, 39, the following discussion will be limited to the upper bow limb 28, and in particular the adjustable attachment of the limb inner end 29 of the upper bow limb 28 to the upper riser mounting end 17 of the bow riser 14. However, it is appreciated that references made to the upper components of the archery bow 11 will apply equally and analogously to the corresponding lower parts as well.

Figure 1:
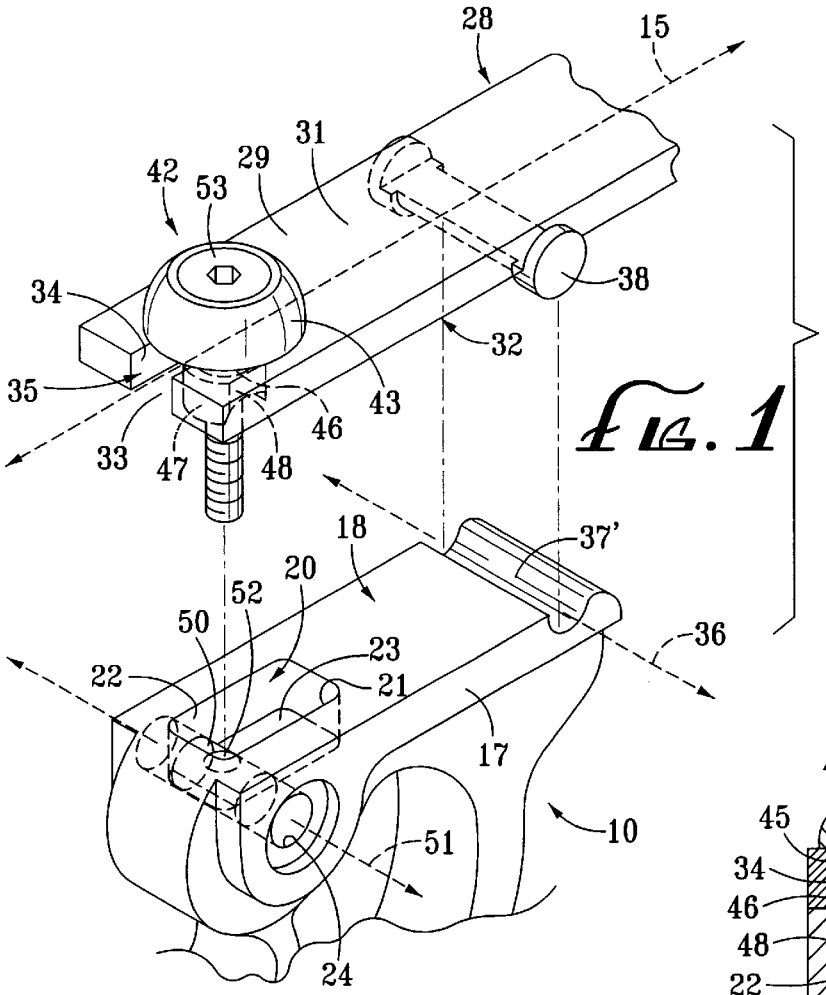
FIG. 1 is a perspective view of the bow limb mounting system shown with the bow limb and adjustable strut assembly removed from the bow riser.
Figure 3A:
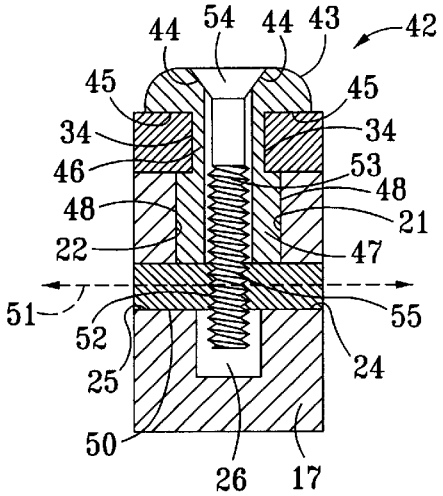
FIG. 3A is a cross-sectional view of the bow limb mounting system taken along line 3—3 of FIG. 2.
Figure 2:
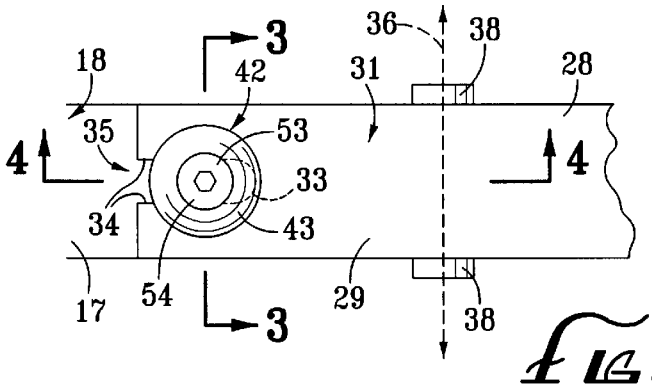
FIG. 2 is a top view of the bow limb mounting system with the bow limb mounted to the bow riser.

As can be best seen in FIG. 1, the mounting system 10 includes a limb inner end 29 of the bow limb 28 which is positioned adjacent a mounting surface 18 of a riser mounting end 17 of the riser 14. Preferably, the limb inner end is positioned immediately against the mounting surface of the riser mounting end without the presence of an intervening structure, such as a common limb mounting pocket. The limb inner end 29 preferably has a planar top surface 31, and a planar bottom surface 32 which contacts or at least directly confronts the mounting surface 18. Additionally, the limb inner end 29 preferably has a connector bore 33 which communicably connects the top and bottom surfaces 31, 32 together. Preferably still, the connector bore 33 is a longitudinally elongated slot 33 having a pair of opposing slot sidewalls 34 and a slot opening 35 at a tip of the limb inner end 29. The slot opening 35 is for receiving a neck portion 46 of a preferred embodiment of an adjustable strut assembly 42 which will be discussed in detail below. The elongated slot 33 is preferably positioned adjacent a cavity 20 located on the riser mounting end 17 below the mounting surface 18, and which has a pair of opposing cavity sidewalls 21, 22 which are oriented parallel to the deflection plane 12 of the archery bow 11 (FIG. 6). Preferably the cavity 20 has a cavity floor 23, below which is a secondary cavity 26 (see FIG. 3A) for receiving the leading end of a shank portion 55 of a bolt fastener 53, as will be discussed below.

Additionally, as can be seen in FIGS. 1, 4, and 5, the limb inner end 29 has means for pivoting the limb inner end 29 relative to the riser mounting end 17 about a limb pivot axis 36 which is normal to the deflection plane 12 (FIG. 6). The means for pivoting is preferably a transversely oriented protrusion 37 below the planar lower surface 32 and having a concave, semi-circular cross-section. Moreover, the protrusion 37 is preferably bounded at its ends by side flanges 38 which straddle the riser mounting end 17 of the riser 14 (see FIG. 2). In this regard, the riser mounting end 17 preferably has a limb pivot groove 37' adapted to pivotally and matingly receive the protrusion 37. As can be best seen in FIGS. 1, 4, and 5, the limb pivot groove 37' is preferably positioned at a tip portion of the riser mounting end to prevent the protrusion 37 from lifting out of the limb pivot groove 37' at all adjusted positions. Furthermore, while the present embodiment is shown with the limb pivot axis at or proximately near the mounting surface 18 of the riser mounting end 17, it can alternatively be located above or below the mounting surface 18 depending on the particular pivot configuration and point of attachment.

As can be best seen in FIGS. 1, and 3–5, the mounting system 10 additionally has an adjustable strut assembly, generally indicated at reference character 42 which operates to pivot the limb inner end 29 about the limb pivot axis 36. Generally, the adjustable strut assembly 42 has upper means for connecting to the limb inner end 29, which is adapted to laterally restrain the limb inner end 29 relative to the adjustable strut assembly 42, lower means for pivotally connecting to the riser mounting end 17 such that the adjustable strut assembly 42 pivots about a strut pivot axis 51 normal to the deflection plane 12, and means for adjusting the distance between the upper means and the strut pivot axis 51. Furthermore, the adjustable strut assembly 42 preferably also includes central means for slidably and matingly engaging the pair of opposing cavity sidewalls 21, 22. The central means is preferably connected to end functions together with the upper means to restrain the bow limb 28 and the bow riser 14 from lateral movement relative to each other. In this regard the central means is preferably integrally connected to the upper means, and both the upper means and lower means have a close tolerance fit with the corresponding limb inner end 29 and pair of cavity sidewalls 21, 22. In this manner, the adjustable strut assembly is designed to resist pressure or compressive stress in the direction of its length.

In a preferred embodiment of the adjustable strut assembly 42, as best shown in FIGS. 1 and 3–5, the upper means is a combination head portion 43, and neck portion 46 extending below the head portion 43. As can be best seen in FIGS. 3A and 3B, the head portion 43 has a fastening surface 44 which faces away from the preferred planar top surface 31, and an abutment surface 45 which abuts the planar top surface 31. The fastening surface 44 preferably has an inverted frusto-conical shape for receiving a bolt head 54 of a bolt fastener 53 (see discussion below). Furthermore, the neck portion 46 is preferably integrally connected to and extends below the abutment surface 45 of the head portion 43. The neck portion 46 is adapted to contactedly extend through the connector bore 33. And where the connector bore 33 is a longitudinally elongated slot 33 as shown in the figures, the neck portion 46 slidably contacts the slot sidewalls 34 with a close tolerance fit, typically in the range of several thousandths of an inch on each side.

And where the mounting system 10 incorporates the central means, it is preferably an alignment block 47 integrally connected to the neck portion 46 and having a pair of opposing alignment walls 48 which slidably and matingly contact the pair of opposing cavity sidewalls 21, 22 of the cavity 20. Similar to the contact between the neck portion 46 and the slot sidewalls 34, the contact between the alignment walls 48 and the cavity sidewalls 21, 22 also has a close tolerance fit. The head portion 43, neck portion 46, and the alignment block 47 together have a central strut bore 49 extending therethrough for receiving the means for adjusting the distance between the upper means and the strut pivot axis 51 (see below). As can be best seen in FIGS. 3A, 4, and 5, the alignment block 47 preferably has a width greater than that of the neck portion 46, to capture the limb inner end 28 between the alignment block 47 and the abutment surface 45 of the head portion 43. With this configuration, the adjustable strut assembly 42 may securely engage the limb inner end 28 by entering through the slot opening 35 at a tip portion of the limb inner end 28 (FIG. 1). Moreover, it is appreciated that the preferably integral construction of the head portion 43, neck portion 46, and the alignment block 47 functions as a unitary structure serving to restrain lateral movement between the limb inner end 28 and the riser mounting end 17.

The adjustable strut assembly 42 also includes the lower means for pivotally connecting to the riser mounting end 17 such that the adjustable strut assembly 42 pivots about a strut pivot axis 51 normal to the deflection plane 12. As can be seen in FIGS. 1, 3–5, the lower means is preferably a cylindrical pivot pin 50 slidably positioned in the cavity 20 of the riser mounting end 17, and secured at its ends to the riser mounting end 17. The pivot pin 50 has a threaded bore 52 oriented normal to the strut pivot axis 51 for threadedly receiving the connecting portion of the means for adjusting the distance between the upper means and the strut pivot axis 51. In particular, the means for adjusting is preferably a bolt fastener 53 having a bolt head 54 and an elongated threaded shank 55. The bolt head 54 is preferably tapered to sit flush with the preferably frusto-conically shaped fastening surface 44 of the head portion 43 when tension is applied to the bow limb 28. The threaded shank 55 is partially extended through the central strut bore 49, threadedly lots engaged to the threaded bore 52 of the pivot pin 50, and preferably extended into the secondary cavity 26 below the cavity floor 23. The secondary cavity 26 is suitably spaced to allow longitudinal movement of a tip portion of the threaded shank 55 as the bolt 53 pivots about the strut pivot axis 51. It is notable that the upper, central, and lower means are preferably manufactured out of a machinable metal in a manner known in the relevant art, to produce a high precision and close tolerance fit with the corresponding contact surfaces.

In this manner, adjustment operation of the mounting system 10 may be effected by threadedly inserting or removing the bolt 53 from the pivot pin 50. It is appreciated that the force provided by the bowstring 13 on the bow limb 28 serves to make the limb inner end 29 of the bow limb 28 function as a lever arm, thereby effecting the pull away from the mounting surface 18. When the bolt 53 is fully secured to the pivot pin 50, as shown in FIG. 4, the planar bottom surface 32 of the limb inner end 29 is parallel with the mounting surface 18. As shown in FIG. 5, when the bolt 53 is suitably released from the pivot pin 50, a positive attachment angle A is produced between the planar bottom surface 32 and the mounting surface 18. In a preferred embodiment, the abutment surface 45 of the head portion 43 slidably abuts a planar slide surface of the limb inner end 29 which is preferably the planar top surface 31. And the neck portion 46 extending through the longitudinally elongated slot 34 also contactedly slides along the slot sidewalls 34. It is appreciated that the head and neck portions 43 and 46, respectively, will slide upon adjustment of the bolt 53 due to a natural tendency under high axial pressures to orthogonally align itself with a longitudinal axis 15 of the bow limb 28 and thereby pivot relative to the bow riser 14.

In a final preferred embodiment, as shown in FIGS. 4 and 5, the mounting system 10 includes means for measuring relative bowstring tension of the archery bow 11 as a function of the attachment angle A between the limb inner end 29 of the bow limb 28 and the riser mounting end 17 of the bow riser 14. Preferably the means for measuring relative bowstring tension is a set of gradations 57 on the central means of the adjustable strut assembly, i.e. the alignment block 47, facing inward towards the center of the bow riser 17. The set of gradations 57 correspond to a range of bowstring tensions, and are preferably read relative to the mounting surface 18 of the riser mounting end 17. In this manner a user may adjust the bolt 53 to a desired relative bowstring tension by lining the mounting surface 18 to a desired gradation representing a particular tension or pull force setting, to thereby operate the archery bow at the preferred tension and bowstring pull force.

It is notable that the bow limb 28 is preferably made of fiberglass, or other lightweight composite material capable of flexing to provide a suitable tension in the bowstring 13. And the bow riser 14 is preferably made of a lightweight rigid material, such as aluminum or other lightweight metal, or a composite material, such as graphite, fiberglass, etc.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A mounting system for adjustably mounting a bow limb to a bow riser of an archery bow, said mounting system comprising:

a riser mounting end of said bow riser having a mounting surface and a cavity below said mounting surface, said cavity having a pair of opposing cavity sidewalls parallel to a deflection plane of said archery bow;

a limb inner end of said bow limb positioned immediately against said mounting surface of said riser mounting end, said limb inner end having means for pivoting said limb inner end relative to said riser mounting end about a limb pivot axis normal to said deflection plane of said archery bow, wherein a bottom surface of said limb inner end contacts said mounting surface of said riser mounting end when said limb inner end remains unpivoted; and an adjustable strut assembly having upper means for connecting to said limb inner end of said bow limb, said upper means adapted to laterally restrain said limb inner end relative to said adjustable strut assembly, central means for slidably and matingly engaging said pair of opposing cavity sidewalls, said central means connected to said upper means whereby said central means and said upper means together restrain said bow limb and said bow riser from lateral movement relative to each other, lower means for pivotally connecting to said riser mounting end of said bow riser wherein said adjustable strut assembly pivots about a strut pivot axis normal to said deflection plane of said archery bow, and means for adjusting the distance between said upper means and said strut pivot axis of said lower means whereby adjusting said means for adjusting varies an attachment angle between the bottom surface of said limb inner end of said bow limb and the mounting surface of said riser mounting end of said bow riser.

2. The mounting system as in claim 1, wherein said limb inner end has a top surface opposite said bottom surface, and a connector bore connecting said top and bottom surfaces, wherein said upper means has a head portion with an abutment surface abutting said top surface of said limb inner end, and a neck portion connected to said head portion and contactedly extending through said connector bore of said limb inner end, wherein said central means is an alignment block connected to said neck portion and having a pair of opposing alignment walls slidably and matingly contacting said pair of opposing cavity sidewalls of said cavity, said head portion, neck portion, and alignment block together having a central strut bore extending therethrough, wherein said lower means is a pivot pin pivotally mounted on said riser mounting end through said cavity, said pivot pin having a threaded bore oriented normal to said strut pivot axis, and wherein said means for adjusting is a bolt having a bolt head abutting said head portion, and a threaded shank partially extending through said central strut bore and threadedly engaging said threaded bore of said pivot pin.

3. The mounting system as in claim 1, wherein said upper means is adapted to slide along a slide surface of said limb inner end in the direction of a longitudinal axis of said bow limb.

4. The mounting system as in claim 3, wherein said limb inner end has a longitudinally elongated slot, wherein said upper means has a head portion with an abutment surface slidably abutting said slide surface of said limb inner end, and a neck portion connected to said head portion and contactedly extending through said longitudinally elongated slot, wherein said central means is an alignment block connected to said neck portion and having a pair of opposing alignment walls slidably and matingly contacting said pair of opposing cavity sidewalls of said cavity, said head portion, neck portion, and alignment block together having a central strut bore extending therethrough, wherein said lower means is a pivot pin pivotally mounted on said riser mounting end through said cavity, said pivot pin having a threaded bore oriented normal to said strut pivot axis, and wherein said means for adjusting is a bolt having a bolt head abutting said head portion, and a threaded shank partially extending through said central strut bore and threadedly engaging said threaded bore of said pivot pin.

5. The mounting system as in claim 1, wherein said adjustable strut assembly further includes a set of gradations on said central means of said adjustable strut assembly which correspond to a range of bowstring tensions and which are read relative to the mounting surface of said riser mounting end, for measuring relative bowstring tension of said archery bow as a function of said attachment angle.

6. A mounting system for adjustably mounting a bow limb to a bow riser of an archery bow, said mounting system comprising:

a riser mounting end of said bow riser having a mounting surface;

a limb inner end of said bow limb positioned adjacent said mounting surface of said riser mounting end, said limb inner end having means for pivoting said limb inner end relative to said riser mounting end about a limb pivot axis normal to a deflection plane of said archery bow;

an adjustable strut assembly having upper means for connecting to said limb inner end of said bow limb, lower means for pivotally connecting to said riser mounting end of said bow riser wherein said adjustable strut assembly pivots about a strut pivot axis normal to said deflection plane of said archery bow, and means for adjusting the distance between said upper means and said strut pivot axis of said lower means, whereby adjusting said means for adjusting varies an attachment angle between said limb inner end of said bow limb and said riser mounting end of said bow riser; and a set of gradations on said central means of said adjustable strut assembly which correspond to a range of bowstring tensions and which are read relative to the mounting surface of said riser mounting end, for measuring relative bowstring tension of said archery bow as a function of said attachment angle.

7. The mounting system as in claim 6, wherein said riser mounting end has a cavity below said mounting surface, said cavity having a pair of opposing cavity sidewalls parallel to a deflection plane of said archery bow, wherein said upper means of said adjustable strut assembly is adapted to laterally restrain said limb inner end relative to said adjustable strut assembly, wherein said adjustable strut assembly further comprises central means for slidably and matingly engaging said pair of opposing cavity sidewalls whereby said central means and said upper means together restrain said bow limb and said bow riser from lateral movement relative to each other.

8. The mounting system as in claim 6, wherein said limb inner end has a top surface opposite said bottom surface, and a connector bore connecting said top and bottom surfaces, wherein said upper means has a head portion with an abutment surface abutting said top surface of said limb inner end, and a neck portion connected to said head portion and contactedly extending through said connector bore of said limb inner end, wherein said central means is an alignment block connected to said neck portion and having a pair of opposing alignment walls slidably and matingly contacting said pair of opposing cavity sidewalls of said cavity, said head portion, neck portion, and alignment block together having a central strut bore extending therethrough, wherein said lower means is a pivot pin pivotally mounted on said riser mounting end through said cavity, said pivot pin having a threaded bore oriented normal to said strut pivot axis, and wherein said means for adjusting is a bolt having a bolt head abutting said head portion, and a threaded shank partially extending through said central strut bore and threadedly engaging said threaded bore of said pivot pin.

9. The mounting system as in claim 6, wherein said upper means is adapted to slide along a slide surface of said limb inner end in the direction of a longitudinal axis of said bow limb.

10. The mounting system as in claim 9, wherein said limb inner end has a longitudinally elongated slot, wherein said upper means has a head portion with an abutment surface slidably abutting said slide surface of said limb inner end, and a neck portion connected to said head portion and contactedly extending through said longitudinally elongated slot, wherein said central means is an alignment block connected to said neck portion and having a pair of opposing alignment walls slidably and matingly contacting said pair of opposing cavity sidewalls of said cavity, said head portion, neck portion, and alignment block together having a central strut bore extending therethrough, wherein said lower means is a pivot pin pivotally mounted on said riser mounting end through said cavity, said pivot pin having a threaded bore oriented normal to said strut pivot axis, and wherein said means for adjusting is a bolt having a bolt head abutting said head portion, and a threaded shank partially extending through said central strut bore and threadedly engaging said threaded bore of said pivot pin.

11. A mounting system for adjustably mounting a bow limb to a bow riser of an archery bow, said mounting system comprising:

a riser mounting end of said bow riser having a mounting surface and a cavity below said mounting surface, said cavity having a pair of opposing cavity sidewalls parallel to a deflection plane of said archery bow;

a limb inner end of said bow limb having a top surface, a bottom surface opposite said top surface and positioned adjacent said mounting surface of said bow riser, a connector bore connecting said top and bottom surfaces, and means for pivoting said limb inner end relative to said riser mounting end about a limb pivot axis normal to said deflection plane of said archery bow; and an adjustable strut assembly, having a head portion with an abutment surface abutting said top surface of said limb inner end, a neck portion connected to said head portion and contactedly extending through said connector bore of said limb inner end, for laterally restraining said limb inner end relative to said adjustable strut assembly;

an alignment block connected to said neck portion and having a pair of opposing alignment walls slidably and matingly contacting said pair of opposing cavity sidewalls of said cavity whereby said neck portion and said alignment block together restrain said bow limb and said bow riser from lateral movement relative to each other, and wherein said head portion, neck portion, and alignment block together have a central strut bore extending therethrough, a pivot pin pivotally mounted on said riser mounting end through said cavity and defining a strut pivot axis normal to said deflection plane of said archery bow, said pivot pin having a threaded bore oriented normal to said strut pivot axis, for pivotally connecting said adjustable strut assembly to said riser mounting end of said bow riser, and a bolt for adjusting the distance between the head portion and the strut pivot axis of said pivot pin, said bolt having a bolt head abutting said head portion, and a threaded shank partially extending through said central strut bore and threadedly engaging said threaded bore of said pivot pin, whereby adjusting said bolt varies an attachment angle between the bottom surface of said limb inner end and the mounting surface of said riser mounting end.

12. The mounting system as in claim 6, wherein said upper means is adapted to slide along a slide surface of said limb inner end in the direction of a longitudinal axis of said bow limb.

13. The mounting system as in claim 12, wherein said limb inner end has a longitudinally elongated slot, wherein said upper means has a head portion with an abutment surface slidably abutting said slide surface of said limb inner end, and a neck portion connected to said head portion and contactedly extending through said longitudinally elongated slot, wherein said central means is an alignment block connected to said neck portion and having a pair of opposing alignment walls slidably and matingly contacting said pair of opposing cavity sidewalls of said cavity, said head portion, neck portion, and alignment block together having a central strut bore extending therethrough, wherein said lower means is a pivot pin pivotally mounted on said riser mounting end through said cavity, said pivot pin having a threaded bore oriented normal to said strut pivot axis, and wherein said means for adjusting is a bolt having a bolt head abutting said head portion, and a threaded shank partially extending through said central strut bore and threadedly engaging said threaded bore of said pivot pin.

14. The mounting system as in claim 11, wherein said adjustable strut assembly further includes a set of gradations on said central means of said adjustable strut assembly which correspond to a range of bowstring tensions and which are read relative to the mounting surface of said riser mounting end, for measuring relative bowstring tension of said archery bow as a function of said attachment angle between the bottom surface of said limb inner end and the mounting surface of said riser mounting end.

* * * * *